United States Patent [19]

Sewell et al.

[11] 4,355,562

[45] Oct. 26, 1982

[54] ARMOR

[75] Inventors: Robert G. S. Sewell; John K. Pringle; Marvin E. Backman, all of Ridgecrest; Stephen A. Finnegan, China Lake, all of Calif.

[73] Assignee: The United States of America as represented by the Secretary of the Navy, Washington, D.C.

[21] Appl. No.: 129,046

[22] Filed: Mar. 12, 1980

[51] Int. Cl.[3] ..... F41H 5/00

[52] U.S. Cl. ..... 89/36 A; 89/36 R; 109/84; 428/471

[58] Field of Search ..... 89/36 R, 36 A; 428/911, 428/469, 471, 472; 109/49.5, 80, 82, 84

[56] References Cited

U.S. PATENT DOCUMENTS

| | | | |
|---|---|---|---|
| 3,380,406 | 4/1968 | Gosnell | 89/36 A |
| 3,395,067 | 7/1968 | Lane | 89/36 A |
| 3,563,836 | 2/1971 | Dunbar | 89/36 A |
| 3,649,426 | 3/1972 | Gates | 109/84 |
| 4,048,365 | 9/1977 | Hoover | 428/215 |
| 4,079,161 | 3/1978 | Kile | 428/220 |

*Primary Examiner*—Donald P. Walsh

*Attorney, Agent, or Firm*—Robert F. Beers; W. Thom Skeer

[57] ABSTRACT

A new, lightweight armor plating for important installations or control centers is disclosed whereupon being struck by a projectile restricts the ensuing shock wave to a narrow beam-like path always perpendicular to patterns of striation engrained in said armor. This response dissipates the projectile's kinetic energy more rapidly. The new armor is lighter than traditional forms of armor.

4 Claims, 8 Drawing Figures

ARMOR

BACKGROUND OF THE INVENTION

The purpose of an armor plate is to protect men and equipment from projectiles or nuclear fall-out or blast by acting as a barrier. The principal factors governing the degree of protection afforded by armor are its thickness and the angle of slope of the armor with respect to the line of fire.

When projectiles strike and penetrate an armor plate, their destructive force is diminished by consumption of kinetic energy required to traverse the plate. The greater the traverse, the greater the consumption. Conventionally, such traverse depends primarily on thickness of the plate or on the amount of deflection of the projectile that the armor can cause. Steel armor one inch in thickness weighs 40.8 pounds per square foot. As an example, a light tank fitted with more than 500 square feet of one-inch armor would thus carry more than 10 tons of armor.

One solution to the weight problem has been to provide a composite plate of two or more materials sandwiched into a unit whereby the several materials contribute to increase the protective efficiency. For example, the materials may be of different densities so that the planes at which the materials join act as planes of deflection to cause a projectile to travel diagonally through the plate. Although a composite plate can offer greater protection than a plate of a single material, the same problem of thickness and weight are similarly disadvantageous.

Another solution has been to assemble small, substantially equal-sized, load distributing platelets within a matrix of less rigid material; the platelets being arranged within the matrix in a shingled, statistically interdependent or geometric pattern, and being bonded thereto with or without the aid of adhesives. Although effective against small caliber projectiles, this armor is neither fabricated to withstand shaped charges, nor very large projectiles.

Looking at the problem from another view, the mechanical porperties of the structural materials must be considered. These properties are known to be sensitive to fracture initiation resulting from the dynamic loading of the material. Many of these materials, including those used in a variety of structures ranging from nuclear pressure vessels to ship hulls, exhibit a marked decrease in fracture resistance under dynamic loading conditions. Such conditions may arise as a result of an impact from a warhead or other disturbance which results in the propagation of stress waves through a significant portion of the structure.

The resistance of a material to dynamic loading may be determined by computing the volume changes from the changes in linear dimensions under pressure. If the material is non-isotropic, measurements of linear changes in as many as three mutually perpendicular directions may be required to determine the volume change.

One value used to characterize a material in this light is the Poisson's Ratio, which is the ratio of the relative lateral deformation to the relative axial deformation. A representative figure for the Poisson's ratio for one type of structural steel is 0.29. For a certain type of graphite, it is 0.20. Depending on the density of the material, the lower the Poisson's Ratio in a given direction, the better the material acts as an armor to shield against projectile strikes from that direction.

SUMMARY OF THE INVENTION

A new, lightweight, dynamic armor is disclosed that is suitable for use in protecting important installations or control centers, such as on board a ship. The armor is characterized by the fact that it exhibits a low, anisotropic Poisson's Ratio when impacted by a projectile fired at velocities ranging from low to very high. The new lightweight dynamic armor of this invention restricts the ensuing shock pattern to a narrow, beam-like path which is always perpendicular to patterns of striations engrained in the material, thus dissipating the incident projectile's kinetic energy. The new armor is lighter than corresponding segments of conventional armor.

OBJECTS OF THE INVENTION

An object of this invention is to provide an improved, lightweight dynamic armor for protecting vital installations or important areas.

Another object of this invention is to provide an improved, lightweight dynamic armor for protecting the engines of a ship, a ship's magazine, or the advanced electronic machinery on board.

A further object of this invention is to provide an armor plate that provides novel deflecting capabilities that cause internal deflection of projectiles fired into the plate.

A still further object of this invention is to provide an armor with a low Poisson's Ratio, along the axial direction, that forms a shield against a projectile wherein the projectile's shear line is always perpendicular to the striation patterns in the armor.

These and other objects of this invention will appear from the following specification, and are not to be construed as limiting the scope of the invention thereto, since in view of the disclosure herein, others may be able to make additional embodiments within the scope of the appended claims.

DISCLOSURE OF THE PREFERRED EMBODIMENT

Figure 1:
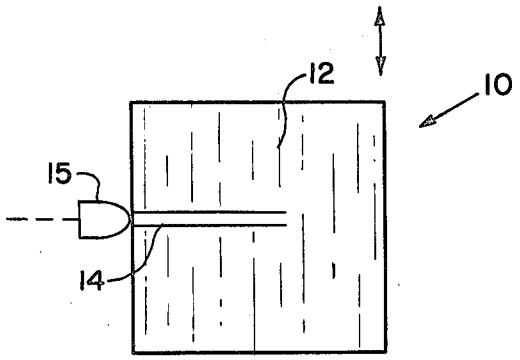
FIG. 1 is a fragmentary schematic view of the armor of the present invention illustrating the general distribution of stresses throughout the armor due to the impact of a projectile.

Referring in detail to the figures, wherein like numerals designate like parts, FIG. 1 shows the result when a projectile 15 strikes a block of travertine 10. The travertine 10 is lighter in weight when compared to conventional armor and has patterns or lines of striation 12 engrained throughout. When the projectile 15 strikes the travertine perpendicular to the face of the block, the resulting shear lines 14 are perpendicular to the lines of striation 12 engrained within.

Figure 2:
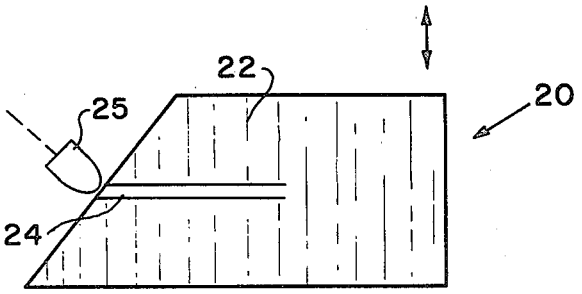
FIG. 2 is a view similar to FIG. 1 showing a projectile striking the amor from a different angle.

FIG. 2 shows a block of travertine 20 with its face cut to an oblique angle. When a projectile 25 strikes the face perpendicular to its surface, the resulting shear lines 24 are not parallel to the direction of travel of the projectile as in FIG. 1, but rather these lines 24 form perpendicular to the lines of striation 22.

Figures 3A, 3B:
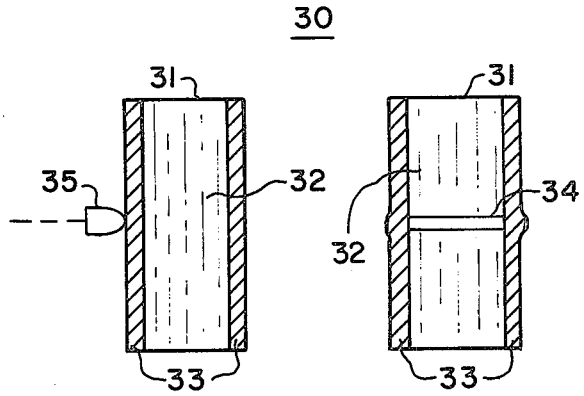
FIGS. 3*a* and 3*b* are fragmentary schematic views of another embodiment of the present invention showing a projectile striking a sandwich-constructed armor.

FIGS. 3*a* and 3*b* show the result when a projectile 35 strikes an armor plate 30 composed of travertine 31 sandwiched between two steel plates 33. In FIG. 3*a*, a projectile 35 impacts a first steel plate at an angle perpendicular to its surface. FIG. 3*b* shows that the resulting shear lines 34 will be perpendicular to the lines of striation 32 throughout the travertine 31.

Figures 4A, 4B:
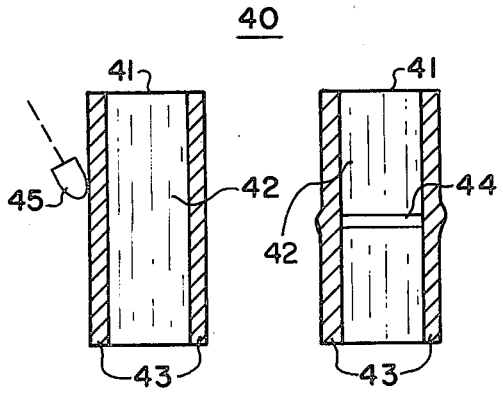
FIGS. 4*a* and 4*b* are views similar to FIGS. 3*a* and 3*b* showing a projectile striking the sandwich-constructed armor from a different angle.

FIGS. 4*a* and 4*b* show the result when a projectile 45 strikes an armor plate 40 at an oblique angle. In FIG. 4*a*, the projectile impacts a first steel plate 43, at an oblique angle to the surface of the steel plate. The resulting shear lines 44 (as shown in FIG. 4*b*) are not parallel to the direction of travel of the projectile 45, but rather, form perpendicular to the lines of striation 42 engrained in the travertine 41.

Figure 5:
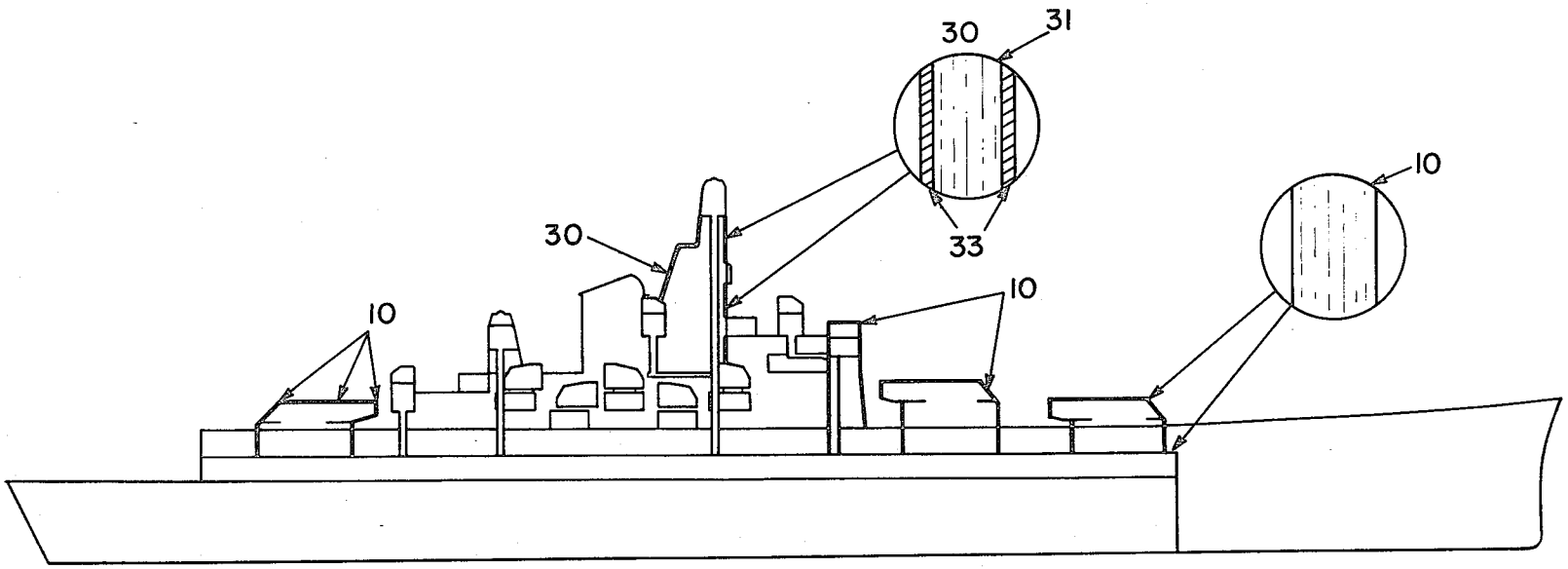
FIG. 5 is a partial sideview of a warship protected at key locations by the instant invention.
Figure 6:
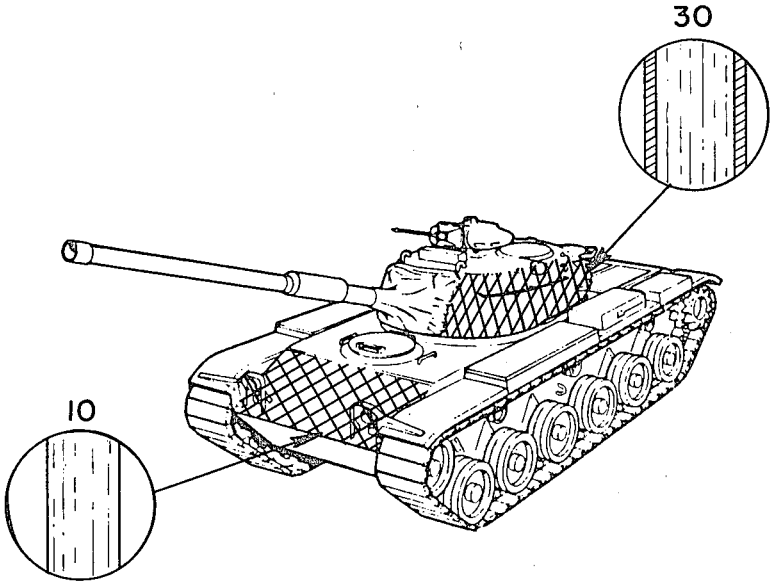
FIG. 6 is a perspective view of a battle tank incorporating the instant invention.

The effect of using travertine either by itself or with steel plates to protect vital installations, such as on board ship to protect magazines or command centers (as in FIG. 5), or on tanks (as in FIG. 6) is to constantly deflect the energy of deformation that is developed when the projectile strikes in direction perpendicular to the lines of striation. This result in confirmed by the fact that the Poisson's Ratio for travertine is extremely low in this direction. Tests have measured this number to be between 0.009 to 0.010.

The other unique feature exhibited by travertine is the resulting pattern formed by the shock wave of the projectile as it travels through the material. As shown in the various figures, the shear lines that develop remain parallel throughout the distance traveled and do not expand very much. This is in constrast to normal armor wherein the shear lines diverge from one another. As seen in FIGS. 2 and 4, when the projectile strikes at an angle, the resulting shear lines remain parallel, as well as being normal to the pattern or lines of striation.

The preparation of travertine for use on board a ship (FIG. 5) or a tank (FIG. 6) is similar to known mining or quarrying techniques. The direction in which the naturally occurring patterns of striations 12 run is noted, and large pieces are carried from the site. Then, using a cable saw, slabs of travertine 10 are cut into 10′×10′ squares of a desired thickness. Gem cutting tools are used to further reduce the size when necessary. Travertine 10 is bonded to steel plates 33 (FIG. 3) using standard commercial techniques.

What is claimed is:

1. Lightweight armor plating for protecting vital installations or control centers which comprises:

travertine material of a predetermined thickness that causes an incident projectile to form shear lines that are perpendicular to the pattern of striations engrained in said material, said shear lines being restricted to relatively narrow, parallel lines and not expanding out into a conical form as the force from the projectile travels deeper into said armor, thereby dissipating the projectile's kinetic energy.

2. Armor plating as in claim 1 wherein the material is sandwiched between steel plates of a predetermined thickness.

3. In a method for protecting certain vital parts on a ship such as a ship's magazine or control center comprising:

providing a protective material; and covering said vital parts with sheets of said material, the improvement residing in utilizing travertine as said protective material.

4. The method as in claim 3 wherein the protective material is a predetermined thickness of travertine sandwiched between steel plates of a predetermined thickness.

* * * * *